US006532941B2

(12) United States Patent
Begley et al.

(10) Patent No.: US 6,532,941 B2
(45) Date of Patent: Mar. 18, 2003

(54) ELECTRONIC RETURNLESS FUEL SYSTEM

(75) Inventors: Chris Clarence Begley, Ortonville, MI (US); Michael D. Lutton, Grand Blanc, MI (US); Michael Joseph Niemiec, Brighton, MI (US); Charles Wilson Braun, Livonia, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/918,388

(22) Filed: Jul. 30, 2001

(65) Prior Publication Data

US 2002/0043253 A1 Apr. 18, 2002

Related U.S. Application Data

(60) Provisional application No. 60/228,677, filed on Aug. 29, 2000.

(51) Int. Cl.[7] ..... F02M 37/04

(52) U.S. Cl. ..... 123/497; 123/509; 123/514

(58) Field of Search ..... 123/458, 514, 123/509, 497

(56) References Cited

U.S. PATENT DOCUMENTS

| | | | | | |
|---|---|---|---|---|---|
| 4,926,829 | A | * | 5/1990 | Tuckey | 123/497 |
| 5,044,344 | A | * | 9/1991 | Tuckey et al. | 123/497 |
| 5,074,272 | A | | 12/1991 | Bostick et al. | |
| 5,133,323 | A | | 7/1992 | Treusch | |
| 5,148,792 | A | * | 9/1992 | Tuckey | 123/497 |
| 5,237,975 | A | | 8/1993 | Betki et al. | |
| 5,379,741 | A | | 1/1995 | Matysiewicz | |
| 5,398,655 | A | * | 3/1995 | Tuckey | 123/456 |
| 5,448,977 | A | | 9/1995 | Smith et al. | |
| 5,692,479 | A | * | 12/1997 | Ford et al. | 123/514 |
| 5,701,869 | A | | 12/1997 | Richardson et al. | |
| 5,732,684 | A | * | 3/1998 | Thompson | 123/514 |
| 5,743,239 | A | * | 4/1998 | Iwase | 123/514 |
| 5,749,345 | A | * | 5/1998 | Treml | 123/456 |
| 5,791,317 | A | * | 8/1998 | Eck | 123/514 |
| 5,794,597 | A | | 8/1998 | Schwegler et al. | |
| 5,848,583 | A | | 12/1998 | Smith et al. | |
| 5,967,120 | A | | 10/1999 | Blanton et al. | |
| 6,164,325 | A | * | 12/2000 | Braun | 123/514 |
| 6,293,256 | B1 | * | 9/2001 | Kleppner et al. | 123/509 |
| 2001/0018908 | A1 | * | 9/2001 | Joos et al. | 123/497 |
| 2001/0023687 | A1 | * | 9/2001 | Ushigome | 123/509 |

* cited by examiner

*Primary Examiner*—Thomas N. Moulis
(74) *Attorney, Agent, or Firm*—Vincent A. Cichosz

(57) ABSTRACT

An electronic returnless fuel system for a vehicle includes a fuel pump to pump fuel from a fuel tank. The electronic returnless fuel system also includes a fuel rail fluidly connected to the fuel pump to distribute the fuel to an engine of the vehicle and a pressure transducer to sense pressure of the fuel from the fuel pump to the fuel rail. The electronic returnless fuel system includes a controller electrically connected to the pressure transducer and the fuel pump to control the pressure of the fuel from the fuel pump to the fuel rail at a set operating pressure. The electronic returnless fuel system further includes a pressure relief valve interconnecting the fuel pump and the fuel rail set a predetermined amount above the set operating pressure and at least one jet pump disposed in the fuel tank and fluidly connected to the pressure relief valve.

19 Claims, 2 Drawing Sheets

ELECTRONIC RETURNLESS FUEL SYSTEM

CROSS-REFERENCE TO RELATED APPLICATION(S)

The present invention claims the priority date of copending U.S. Provisional Patent Application Ser. No. 60/228,677, filed Aug. 29, 2000.

TECHNICAL FIELD

The present invention relates generally to fuel systems for vehicles and, more particularly, to an electronic returnless fuel system for a vehicle.

BACKGROUND OF THE INVENTION

It is known to provide a mechanical returnless fuel system for a vehicle, which includes a fuel delivery module, a fuel filter, a fuel pressure regulator, a fuel rail, and fuel injectors. In the mechanical returnless fuel system, a fuel pump of the fuel delivery module typically runs at the maximum flow at all times to deliver fuel to an engine of the vehicle. The purpose of the fuel pressure regulator is to maintain the fuel pressure as the fuel consumption at the engine varies. The fuel pump supplies an amount of fuel greater than the engine can consume. When the engine of the vehicle is turned off, the heat from the engine continues to heat the fuel rail and causes the pressure in the fuel rail to rise. The increased pressure causes the fuel pressure regulator to open and relieve the pressure by dumping the heated fuel into the fuel tank, which generates vapor in the fuel tank.

It is also known to provide an electronic returnless fuel system for a vehicle, which eliminates the pressure regulator and the attendant fuel tank vapor formation by providing a pressure relief valve to relieve the pressure and by controlling the speed of the fuel pump. An example of such an electronic returnless fuel system is disclosed in U.S. Pat. No. 5,237,975 to Betki et al. In this patent, a returnless fuel delivery control system regulates fuel rail pressure at the level needed for precise control of fuel mass flow to fuel injectors at both normal and elevated engine temperatures. Other examples of returnless fuel systems are disclosed in U.S. Pat. Nos. 5,379,741, 5,448,977, and 5,848,583.

In some fuel systems, the fuel tank may be of a saddle or dual tank type. In these types of fuel tanks, jet pumps are used as a low cost method to transfer fuel from a secondary side to a primary side of the fuel tank. However, the jet pump creates a lot of vapor when it transfers the fuel to the primary side of the fuel tank.

Therefore, it is desirable to provide an electronic returnless fuel system for a vehicle that lowers fuel tank pressures and reduces vapor generation and heat input into the fuel tank. It is also desirable to provide an electronic returnless fuel system for a vehicle that reduces excess fuel being dumped into the fuel tank.

SUMMARY OF THE INVENTION

It is, therefore, one object of the present invention to provide an electronic returnless fuel system for a vehicle that lowers pressures in a fuel tank for the vehicle.

It is another object of the present invention to provide an electronic returnless fuel system for a vehicle that reduces vapor generation and heat input in a fuel tank for the vehicle.

It is yet another object of the present invention to provide an electronic returnless fuel system for a vehicle with switchable jet pump operation for a saddle type fuel tank.

To achieve the foregoing objects, the present invention is an electronic returnless fuel system for a vehicle including a fuel pump to pump fuel from a fuel tank. The electronic returnless fuel system also includes a fuel rail fluidly connected to the fuel pump to distribute the fuel to an engine of the vehicle and a pressure transducer to sense pressure of the fuel from the fuel pump to the fuel rail. The electronic returnless fuel system includes a controller electrically connected to the pressure transducer and the fuel pump to control the pressure of the fuel from the fuel pump to the fuel rail at a set operating pressure. The electronic returnless fuel system further includes a pressure relief valve interconnecting the fuel pump and the fuel rail set a predetermined amount above the set operating pressure and at least one jet pump disposed in the fuel tank and fluidly connected to the pressure relief valve.

In addition, the present invention is a method of operating an electronic returnless fuel system for a vehicle. The method includes the steps of sensing a fuel level in a fuel tank of a vehicle and determining whether the sensed fuel level is less than a predetermined value. The method also includes the steps of raising an operating pressure of the fuel in the electronic returnless fuel system and determining whether the fuel level is increasing in the fuel tank. The method further includes the steps of returning to the operating pressure of the electronic returnless fuel system if the fuel level is not increasing.

One advantage of the present invention is that an electronic returnless fuel system is provided for a vehicle. Another advantage of the present invention is that the electronic returnless fuel system replaces the mechanical fuel pressure regulator with a pressure transducer and a pump speed controller to control fuel pressure by controlling a fuel pump of the fuel delivery module. Yet another advantage of the present invention is that the electronic returnless fuel system lowers fuel tank pressures. Still another advantage of the present invention is that the electronic returnless fuel system reduces vapor generation and heat input in a fuel tank for a vehicle. A further advantage of the present invention is that the electronic returnless fuel system has a switchable jet pump operation for a saddle type fuel tank.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
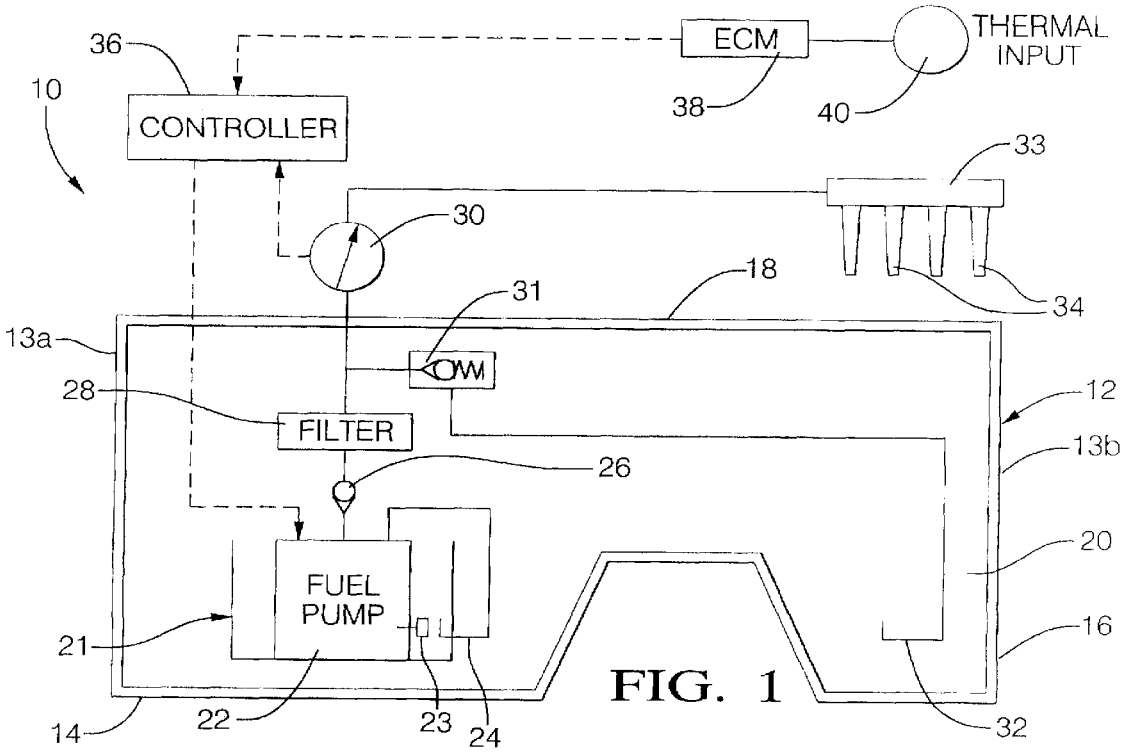
FIG. 1 is a diagrammatic view of an electronic returnless fuel system, according to the present invention.

Referring to the drawings and in particular FIG. 1, one embodiment of an electronic returnless fuel system 10, according to the present invention, is shown for a vehicle (not shown). The electronic returnless fuel system 10 is used with a fuel tank, generally indicated at 12, to hold liquid fuel. In this embodiment, the fuel tank 12 is of a saddle or dual tank type having a primary side 13*a* and a secondary side 13*b*. The fuel tank 12 includes a bottom or base wall 14 and a side wall 16 around a periphery of the base wall 14 and extending generally perpendicular thereto. The fuel tank 12 also includes a top wall 18 extending generally perpendicular to the side wall 16 to form an interior chamber 20. The fuel tank 12 is made of a rigid material, preferably a plastic material. It should be appreciated that the fuel tank 12 could be made of a metal material such as steel. It should also be appreciated that the fuel tank 12 is conventional and known in the art.

The electronic returnless fuel system 10 includes a fuel delivery module, generally indicated at 21, to deliver fuel from the fuel tank 12. The fuel delivery module 21 includes a fuel pump 22 disposed in the interior chamber 20 on the primary side 13*a* of the fuel tank 12 to pump fuel therefrom. The fuel pump 22 is sized by the cold start requirements of the fuel system 10. The fuel delivery module 21 also includes a fuel level sensor or float 23 to sense a fuel level in the primary side 13*a* of the fuel tank 12. It should also be appreciated that the fuel delivery module 21 is conventional and known in the art.

The electronic returnless fuel system 10 also includes a first jet pump 24 disposed in the interior chamber 20 on the primary side 13*a* of the fuel tank 12 and fluidly connected to the fuel pump 22. The electronic returnless fuel system 10 includes a check valve 26 disposed in the fuel tank 12 and fluidly connected to the fuel pump 22 to allow only one-way fluid flow from the fuel pump 22. It should be appreciated that the check valve 26 may be part of the fuel pump 22. It should also be appreciated that the first jet pump 24 and check valve 26 are conventional and known in the art.

The electronic returnless fuel system 10 also includes a fuel filter 28 disposed, preferably, in the interior chamber 20 of the fuel tank 12 and fluidly connected to the check valve 26 to filter contaminants in the fuel to fuel injectors 34. The electronic returnless fuel system 10 also includes a pressure transducer 30 disposed, preferably, outside of the fuel tank 12 and fluidly connected to the fuel filter 28 to sense the pressure of the fuel from the fuel tank 12. The electronic returnless fuel system 10 further includes a pressure relief valve 31 disposed in the interior chamber 20 of the fuel tank 12 and fluidly interconnecting the fuel filter 28 and the pressure transducer 30. The electronic returnless fuel system 10 also includes a second or transfer jet pump 32 disposed in the interior chamber 20 on the secondary side 13*b* of the fuel tank 12 and fluidly connected to the pressure relief valve 31. It should be appreciated that the pressure relief valve 31 is needed to relieve pressure in the fuel system 10 when the engine of the vehicle is turned off and the engine heats the fuel in the fuel rail. It should also be appreciated that the pressure relief valve 31 prevents damage to the fuel system 10 due to over pressurization of the fuel. It should further be appreciated that the fuel filter 28 may be disposed outside of the fuel tank 12 and that the pressure transducer 30 may be disposed inside the fuel tank 12. It should still further be appreciated that the fuel filter 28 is conventional and known in the art. It should also be appreciated that the pressure relief valve 31 must be able to withstand backpressure on the line to the jet pump 32 without changing the relief pressure setting of the pressure relief valve 31.

The electronic returnless fuel system 10 also includes a fuel rail 33 fluidly connected to the pressure transducer 30 to distribute fuel to an engine (not shown) of the vehicle. The electronic returnless fuel system 10 also includes a plurality of fuel injectors 34 connected to the engine and fluidly connected to the fuel rail 33 to inject fuel into the engine. It should be appreciated that the fuel rail 33 and fuel injectors 34 are conventional and known in the art. It should also be appreciated that the check valve 26, fuel filter 28, pressure transducer 30, pressure relief valve 31, and fuel rail 33 are fluidly connected.

The electronic returnless fuel system 10 also includes an electronic controller 36 such as an engine or powertrain controller electrically connected to the fuel pump 22 and the pressure transducer 30. The electronic returnless fuel system 10 further includes an electronic control module (ECM) 38 electrically connected to the controller 36 and a thermal input 40 may be connected to the engine and electrically connected to the ECM 38. The ECM 38 selects and sets an operating pressure of the fuel system 10. The operating pressure may be based on the thermal input 40. The controller 36 receives the selected operating pressure from the ECM 38 and uses the input of fuel pressure from the pressure transducer 30 to create an error signal and generate a pulse width modulated (PWM) voltage that controls the speed of the fuel pump 22 to maintain the set operating pressure. It should be appreciated that the controller 36 may be a separate controller of some other controller in the vehicle such as the ECM 38, vehicle control module, body control module, etc.

In operation, liquid fuel in the fuel delivery module 21 of the fuel tank 12 is pumped by the fuel pump 22 through the check valve 26 and fuel filter 28, pressure transducer 30, fuel rail 33, and fuel injectors 34 into the engine. The electronic returnless fuel system 10 controls fuel pressure by controlling the fuel pump 22 by producing a pulse width modulated voltage closing loop on the set operating pressure and the feedback of the pressure transducer 30. The fuel pump 22 only pumps the amount of fuel needed to keep the fuel rail 33 at the desired or set operating pressure. The first jet pump 24 is used to keep the fuel delivery module 21 filled with fuel and is connected to a constant feed from the fuel pump 22. The second jet pump 32 is turned on and off by the pressure relief valve 31 based upon a calculation from the fuel level sensor 23 in the primary side 13*a* of the fuel tank 12. The fuel levels are monitored and when the fuel level on the primary side 13*a*, where the fuel pump 22 is located, is below a predetermined level, the operating pressure of the fuel system 10 is increased by increasing the PWM signal to the fuel pump 22. The increased pressure will open the pressure relief valve 31 thereby turning on the second jet pump 32 until the primary side 13*a* of the fuel tank 12 is filled with fuel. Once the primary side 13*a* is filled with fuel, as indicated by an increasing then constant fuel level signal from the primary fuel level sensor 23, the operating pressure of the system 10 is returned to normal. The pressure relief valve 31 closes and the second jet pump 32 is turned off. It should be appreciated that vapor generation and heat input into the fuel tank 12 is reduced to the shorter operating time of the transfer jet pump 32.

Figure 2:
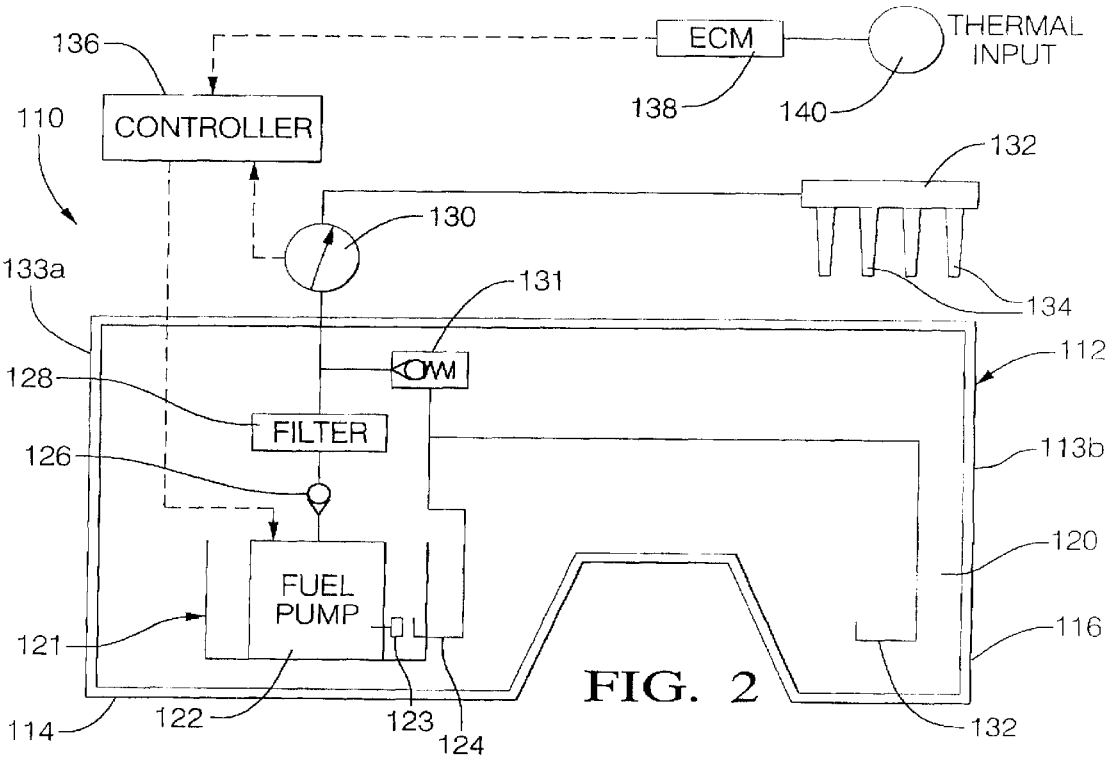
FIG. 2 is a diagrammatic view of another embodiment, according to the present invention, of the electronic returnless fuel system of FIG. 1.

Referring to FIG. 2, another embodiment, according to the present invention, of the electronic returnless fuel system 10 is shown. Like parts of the electronic returnless fuel system 10 have like reference numerals increased by one hundred (100). In this embodiment, the electronic returnless fuel system 110 includes the first jet pump 124 and the second jet pump 132 of the fuel delivery module 121. The first jet pump 124 and second jet pump 132 are fluidly connected to the pressure relief valve 131, which may be fluidly connected before or after the fuel filter 128. The pressure relief valve 131 is set to approximately 10 to 15 kPa. higher than the set operating pressure of the electronic returnless fuel system 110, but the output is ported to the first jet pump 124 and second jet pump 132 to control the operation of the jet pumps 124 and 132. It should be appreciated that the electronic returnless fuel system 110 enables the system pressure to be easily raised and lowered and that the pressure relief valve 131 is required to relieve fuel pressure during hot vehicle soaks. It should also be appreciated that the jet pumps 124 and 132 do not bleed off fuel until the pressure relief valve 131 opens, which is a benefit for starting under low voltage conditions where the output of the fuel pump 122 is limited. It should further be appreciated that because the jet pumps 124 and 132 are not using fuel until approximately system pressure is reached the fuel pump 122 does not have to supply the extra 3 g/s of fuel per jet pump.

In operation of the electronic returnless fuel system 110, the jet pumps 124 and 132 do not use any fuel until the pressure relief valve 131 opens. When the jet pumps 124 and 132 are required, the controller 136 increases the system pressure until the pressure relief valve 131 opens. When the jet pumps 124 and 132 have operated for the needed amount of time, the controller 136 reduces the system pressure to the normal operating value. As illustrated in FIG. 2, the pressure relief valve 131 controls the second jet pump 132 for transferring fuel and the first jet pump 124 for filling the fuel delivery module 121. The jet pumps 124 and 132 are not needed until the fuel level is below the height of the fuel delivery module 121. It should be appreciated that a timer circuit (not shown) could be used to turn the jet pumps 124 and 132 on and off to ensure that the fuel module 121 is always filled with fuel. It should also be appreciated that the primary side 113*a* of the fuel tank 112 determines when the jet pumps 124 and 132 are turned on and off.

Figure 3:
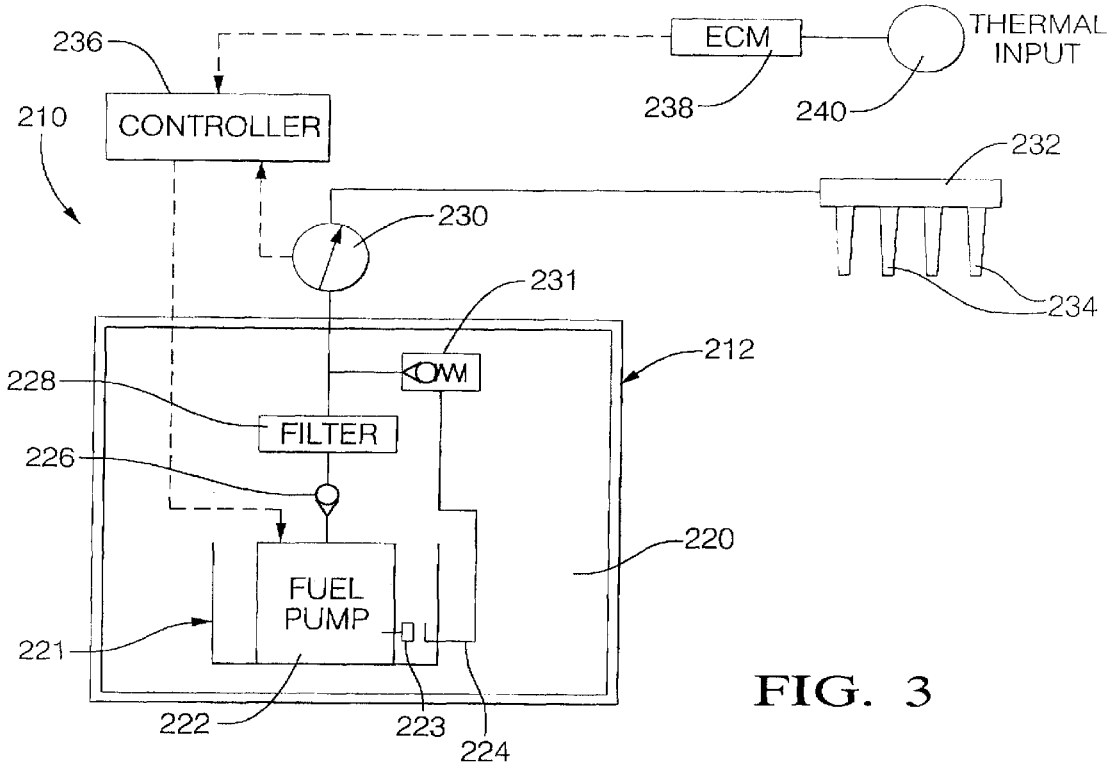
FIG. 3 is a diagrammatic view of yet another embodiment, according to the present invention, of the electronic returnless fuel system of FIG. 1.

Referring to FIG. 3, yet another embodiment, according to the present invention, of the electronic returnless fuel system 10 is shown. Like parts of the electronic returnless fuel system 10 have like reference numerals increased by two hundred (200). In this embodiment, the electronic returnless fuel system 210 is used with a fuel tank 212, which is of a generally rectangular type. The electronic returnless fuel system 210 includes only the first jet pump 224 to fill the fuel delivery module 221. The jet pump 224 is fluidly connected to the pressure relief valve 231, which may be fluidly connected before or after the fuel filter 228. As long as the height of the fuel is above the height of the fuel delivery module 221, the jet pump 224 is not required to operate. Once the fuel level is below the height of the fuel delivery module 221, the jet pump 224 is needed to ensure the fuel delivery module 221 remains full of fuel. The controller 236 increases the fuel pressure to open the pressure relief valve 231 and operate the jet pump 224. The controller 236 operates the pressure relief valve 231 based upon a timer or based upon input from the electronic control module (ECM) 238 generated from fuel consumption.

In operation of the electronic returnless fuel system 210, the jet pump 224 does not use any fuel until the pressure relief valve 231 opens. This results in faster pressurization of the fuel system 210 at start-up. The orifice in the jet pump 224 limits the amount of fuel flow through the pressure relief valve 231. This is a benefit when the fuel system 210 operates at multiple operating pressures. The pressure relief valve 231 is set at a value such as approximately 10 to 15 kPa above the operating pressure of the fuel system 210 and the orifice will minimize or limit the flow through the pressure relief valve 231. It should be appreciated that the jet pump 224 does not bleed off fuel until the pressure relief valve 231 opens, which is a benefit for starting under low voltage conditions where the output of the fuel pump 222 25 is limited.

Figure 4:
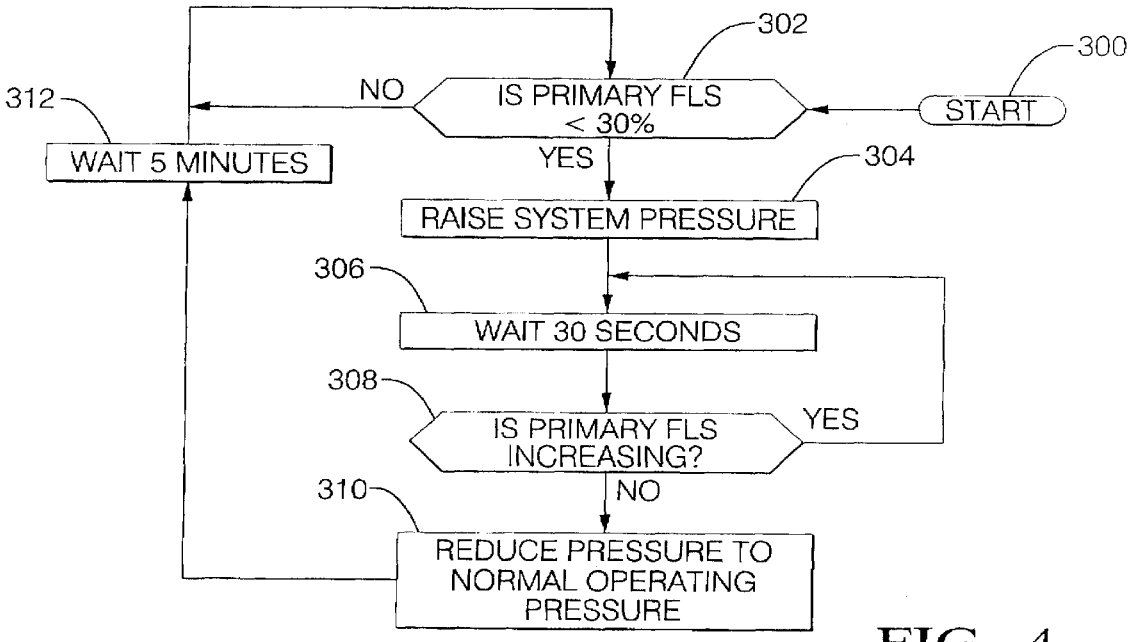
FIG. 4 is a flowchart of a method, according to the present invention, of operation of the electronic returnless fuel system of FIGS. 1 and 2.

Referring to FIG. 4, a method, according to the present invention, of operation of the electronic returnless fuel system 10,110 is shown. The method begins in bubble 300 and advances to diamond 302. In diamond 302, the method determines whether the fuel level in the primary side 13*a*, 113*a* of the fuel tank 12,112 is less than a predetermined value or below the fuel delivery module 21,121. In one embodiment, the method determines the fuel level from the fuel level sensor 23,123 in the primary side 13*a*,113*a* of the fuel tank 12,112, for example, that the fuel level is below thirty percent (30%). If the fuel level is not less than the predetermined value, the method continues to repeat diamond 302. If the fuel level is less than the predetermined value, the method advances to block 304 and the ECM 38,138 raises the operating pressure of the fuel system 10,110. The method then advances to block 306 and waits a predetermined time such as thirty (30) seconds. The method advances to diamond 308 and determines whether the fuel level in the primary side 13*a*,113*a* of the fuel tank 12,112 is increasing. In one embodiment, the method determines from the fuel level sensor 23,123 in the primary side 13*a*,113*a* of the fuel tank 12,112 that the fuel level is increasing. If the fuel level in the primary side 13*a*,113*a* of the fuel tank 12,112 is increasing, the method advances to block 306 previously described. If the fuel level in the primary side 13*a*,113*a* of the fuel tank 12,112 is not increasing, the method advances to block 310 and returns or reduces the operating pressure to the normal operating pressure such as 400 kPa. The method advances to block 312 and waits a second time period such as five (5) minutes. The method then advances to diamond 302 previously described.

Accordingly, the electronic returnless fuel system 10,110, 210 allows the ability to vary the system pressure of the fuel system. By controlling the system pressure, this present invention allows for the control of jet pumps 32,124,132,224 by using a pressure relief valve 31,131,231 as a pressure switch.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An electronic returnless fuel system for a vehicle comprising:

a fuel pump to pump fuel from a fuel tank;

a fuel rail fluidly connected to said fuel pump to distribute the fuel to an engine of the vehicle;

a pressure transducer to sense pressure of the fuel from said fuel pump to said fuel rail;

a controller electrically connected to said pressure transducer and said fuel pump to control the pressure of the fuel from said fuel pump to said fuel rail at a set operating pressure;

a pressure relief valve interconnecting said fuel pump and said fuel rail and set to open a predetermined amount above the set operating pressure; and at least one jet pump disposed in the fuel tank and fluidly connected to said pressure relief valve to operate when said pressure relief valve is opened.

2. An electronic returnless fuel system as set forth in claim 1 wherein said predetermined amount is approximately 10 kPa. to approximately 15 kPa.

3. An electronic returnless fuel system as set forth in claim 1 including a fuel level sensor disposed in the fuel tank and electrically connected to said controller to sense a fuel level in the fuel tank.

4. An electronic returnless fuel system as set forth in claim 3 wherein said at least one jet pump includes a first jet pump disposed in the fuel tank and fluidly connected to said fuel pump.

5. An electronic returnless fuel system as set forth in claim 4 wherein said at least one jet pump includes a second jet pump disposed in the fuel tank and fluidly connected to said pressure relief valve.

6. An electronic retumless fuel system for a vehicle comprising:

a fuel tank having an interior chamber;

a fuel pump disposed in said interior chamber of said fuel tank to pump fuel therefrom;

a fuel rail fluidly connected to said fuel pump to distribute the fuel to an engine of the vehicle;

a pressure transducer to sense pressure of the fuel between said fuel pump to said fuel rail;

a controller electrically connected to said pressure transducer and said fuel pump to control the pressure of fuel to said fuel rail;

a fuel level sensor disposed in the fuel tank and electrically connected to said controller to sense a fuel level in the fuel tank;

a pressure relief valve interconnecting said fuel pump and said fuel rail and set to open a predetermined amount above the set operating pressure; and at least one jet pump disposed in the fuel tank and fluidly connected to said pressure relief valve to operate when said pressure relief valve is opened.

7. A method of operating an electronic returnless fuel system for a vehicle, said method comprising the steps of:

sensing a fuel level in a fuel tank of a vehicle;

determining whether the sensed fuel level is less than a predetermined value;

raising an operating pressure of the fuel in the electronic returnless fuel system;

determining whether the fuel level is increasing in the fuel tank; and reducing the operating pressure of the fuel in the electronic returnless fuel system to the normal operating pressure if the fuel level is not increasing.

8. A method as set forth in claim 7 including the step of repeating said step of sensing if the fuel level is not less than the predetermined value.

9. A method as set forth in claim 7 including the step of waiting a predetermined time after said step of raising.

10. A method as set forth in claim 7 including the step of repeating said step of waiting if the fuel level is increasing.

11. A method as set forth in claim 7 including the step of waiting a predetermined time after said step of reducing.

12. A method as set forth in claim 7 including the step of pumping fuel from a fuel tank to an engine of the vehicle with a fuel pump prior to said step of sensing.

13. A method as set forth in claim 12 including the step of sensing from the fuel pump to the fuel rail with a pressure transducer.

14. A method as set forth in claim 13 including the step of controlling the pressure of the fuel from the fuel pump to the fuel rail at a set operating pressure with a controller electrically connected to the pressure transducer and the fuel pump.

15. A method as set forth in claim 14 including the step of setting a pressure relief valve interconnecting the fuel pump and the fuel rail at a predetermined amount above the set operating pressure to control the operation of a jet pump.

16. A method as set forth in claim 15 wherein said step of setting comprises setting the pressure relief valve at approximately 10 kPa. to approximately 15 kPa. above the set operating pressure.

17. A method as set forth in claim 15 including the step of disposing a jet pump in the fuel tank and fluidly connecting the jet pump to the pressure relief valve.

18. A method as set forth in claim 17 including the step of opening the pressure relief valve and leaking fuel into the fuel tank by the jet pump.

19. A method as set forth in claim 17 including the step of closing the pressure relief valve if the pressure of the fuel drops below a value needed to keep the pressure relief valve open.

* * * * *